US006888316B2

(12) United States Patent
Seo et al.

(10) Patent No.: US 6,888,316 B2
(45) Date of Patent: May 3, 2005

(54) METHOD FOR DRIVING PLASMA DISPLAY PANEL

(75) Inventors: Yoshiho Seo, Kawasaki (JP); Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 97 days.

(21) Appl. No.: 10/335,864

(22) Filed: Jan. 3, 2003

(65) Prior Publication Data

US 2003/0151373 A1 Aug. 14, 2003

(30) Foreign Application Priority Data

Feb. 14, 2002 (JP) ..... 2002-036912

(51) Int. Cl.[7] ..... G09G 3/10; G09G 5/10

(52) U.S. Cl. ..... 315/169.2; 315/169.1; 315/169.4; 315/169.3; 345/66; 345/63

(58) Field of Search ..... 315/169.2, 169.1, 315/169.3, 169.4; 345/66, 64, 63, 67, 60, 37, 55, 61, 41, 68; 313/582, 584

(56) References Cited

U.S. PATENT DOCUMENTS 6,020,687 A * 2/2000 Hirakawa et al. ..... 385/135
6,097,358 A * 8/2000 Hirakawa et al. ..... 345/63
6,256,002 B1 * 7/2001 Shinoda ..... 345/60
6,278,422 B1 * 8/2001 Ukai et al. ..... 345/63
6,633,269 B2 * 10/2003 Huang et al. ..... 345/63
6,642,663 B2 * 11/2003 Okamura et al. ..... 315/169.3
6,747,614 B2 * 6/2004 Takayama ..... 345/60
2002/0122016 A1 * 9/2002 Iwasa et al. ..... 345/60

FOREIGN PATENT DOCUMENTS

JP 10-333635 12/1998

* cited by examiner

*Primary Examiner*—Don Wong
*Assistant Examiner*—Chuc Tran
(74) *Attorney, Agent, or Firm*—Staas & Halsey LLP

(57) ABSTRACT

A method for driving a plasma display panel is provided that can improve luminance and light emission efficiency of display discharge. After addressing for forming wall charge in cells to be lighted, in order to generate display discharge and following reproduction of wall charge in the cell, potential of at least one display electrode is altered so as to differ between start time point and end time point of display discharge, and potential of at least one electrode except the display electrode is altered so as to differ between the start time point and the end time point of the display discharge.

14 Claims, 11 Drawing Sheets

METHOD FOR DRIVING PLASMA DISPLAY PANEL

BACKGROUND OF THE INVENTION

1. Field of the Invention

The present invention relates to a method for driving a plasma display panel (PDP).

A thin television set utilizing a PDP is becoming commonplace. A PDP is suitable for realizing a high definition television set having a larger screen.

2. Description of the Prior Art

A surface discharge AC type PDP is known well as a color display device. This surface discharge type has a three-electrode structure in which first and second display electrodes to be anodes and cathodes in display discharge for determining light emission quantity in a cell are arranged in parallel on a front or a back substrate, and address electrodes are arranged so that one address electrode crosses a pair of display electrodes. There are two forms of arrangement of the display electrodes. One is a form in which a pair of display electrodes is arranged for one row of a matrix display, and another is a form in which first and second display electrodes are arranged alternately at a constant pitch. In the latter case, three display electrodes correspond to two rows, and a display electrode works for displays of neighboring two rows except both edges of the arrangement. Regardless of the arrangement form, the display electrode pairs are covered with a dielectric layer. In the three-electrode structure, the addressing for controlling electrification quantity in the dielectric layer (wall charge quantity) in accordance with contents of the display employs one of the two display electrodes corresponding to each row as a scan electrode for row selection. The addressing is achieved by generating address discharge between the scan electrode and the address electrode, which triggers address discharge between display electrodes. After the addressing, an AC waveform drive voltage is applied to the display electrode pair, so that display discharge is generated on the surface of the substrate only in cells having a predetermined quantity of wall charge.

In addition, a PDP for color displays that is called an opposed surface discharge type is proposed conventionally. An AC type PDP disclosed in Japanese unexamined patent publication No. 10-333635 includes display electrodes for display discharge, scan electrodes for row selection and address electrodes for column selection. Two display electrodes that make a pair extend in parallel and face each other defining a discharge gas space. The scan electrode is arranged in parallel with the display electrode, so that an electrode matrix for addressing is made up of the scan electrodes and the address electrodes. In this type PDP, total four electrodes are in charge of light emission control of each cell.

FIG. 13 shows a usual drive waveform in the conventional method for display discharge that is applied to the three-electrode structure. In the conventional driving method, a sustain pulse of a simple rectangular waveform having the amplitude Vs is applied to the first display electrode and the second display electrode alternately during the display period. Namely, the first and the second display electrodes are temporarily biased to the potential Vs alternately. However, the address electrodes are not biased. According to this potential control, a drive voltage signal having a pulse train of alternating polarities is applied between the first display electrode and the second display electrode (hereinafter referred to as "at XY-interelectrode"). A voltage corresponding to the bias of the display electrode is applied between the address electrode and the first display electrode (hereinafter referred to as "at AX-interelectrode) as well as between the address electrode and the second display electrode (hereinafter referred to as "at AY-interelectrode"). Responding to the first sustain pulse application to all cells, display discharge is generated in the cell having a predetermined quantity of wall charge formed by the previous addressing. After the discharge is generated, wall charge on the dielectric layer is once disappeared, and wall charge is reproduced promptly. The polarity of the reproduced wall charge is opposite to the previous one. Along with the reproduction of the wall charge, cell voltage at the XY-interelectrode drops so that the display discharge finishes. The cell voltage in the AC type is the sum of the voltage generated by the wall charge (wall voltage) and the drive voltage that is applied between electrodes by the electrode bias. The finish of the discharge means that discharge current flowing through a display electrode becomes substantially zero. When the second sustain pulse is applied, the polarity of the drive voltage and the polarity of the wall voltage at that time are the same, and the cell voltage is increased due to the wall voltage that is added to the drive voltage. Therefore, display discharge is generated again. After that, display discharge is generated by every application of the sustain pulse.

Furthermore, the pulse base potential is not necessarily the ground potential (GND). The polarity of the sustain pulse is not always positive as illustrated but can be negative. In addition, it is possible to add a drive voltage signal at the XY-interelectrode similarly to the illustrated one by applying a pulse having the amplitude Vs' to one of two display electrodes and a pulse having the amplitude −(Vs−Vs') to the other display electrode simultaneously.

FIG. 14 is a cell voltage plan view showing the display process according to the conventional driving method. The cell voltage plan view can make a cell state transition understood. In FIG. 14, the horizontal axis is the cell voltage Vc(XY) at the XY-interelectrode, and the vertical axis is the cell voltage Vc(AY) at the AY-interelectrode. The states [1], [1'], [2], [3], [3'] and [4] shown by small circles (○) in FIG. 14 correspond to the time points t[1], t[1'], t[2], t[3], t[3'] and t[4] in FIG. 13, respectively.

The bias of the first display electrode (the application of the sustain pulse) generates display discharge in which the first display electrode is an anode. After this display discharge finishes, in the period till the trailing edge of the pulse, the application of the drive voltage (Vs) at the XY-interelectrode continues so that the space charge is electrostatically attracted by the dielectric layer to become wall charge in electrification. The electrification lasts until the cell voltage Vc(XY) at the XY-interelectrode becomes zero. When the electrification finishes, the wall voltage Vw(XY) at the XY-interelectrode is −Vs and the wall voltage Vw(AY) at the AY-interelectrode is zero. From this state the following state transition (1)–(4) is performed.

(1) In the state [1], the electrification of the wall charge by the electrostatic attraction of the space charge is finished. The drive voltage is cancelled by the wall voltage Vw(XY), and the cell voltage Vc(XY) at the XY-interelectrode is zero. In addition, the second display electrode and the address electrode are not biased, so the cell voltage Vc(AY) at the AY-interelectrode is also zero. When the bias of the first display electrode is finished, the cell voltage Vc(XY) is changed from zero to the value of the wall voltage Vw(XY).

Therefore, the cell voltage Vc(XY) is −Vs in the state [1'].

(2) Next, the drive voltage is added to the wall voltage Vw(XY) by the bias of the second display electrode. In the state [2], Vc(XY) is equal to −2Vs, and Vc(AY) is equal to −Vs. Responding to the transition from the state [1'] to the state [2], display discharge is generated in which the second display electrode is an anode.

(3) Both the wall voltage Vw(XY) and the wall voltage Vw(AY) become Vs by the electrostatic attraction of the display discharge and the space charge. In the state [3], Vc(XY) is equal to 0, and Vc(AY) is equal to zero. When the bias of the second display electrode is finished, the cell voltage Vc(XY) becomes the value of the wall voltage Vw(XY), and the cell voltage Vc(AY) becomes the value of the wall voltage Vw(AY). Therefore, in the state [3'] Vc(XY) is equal to Vs, and Vc(AY) is equal to Vs.

(4) When the first display electrode is biased again, drive voltage is added to wall voltage Vw(XY). In the state [4], Vc(XY) is equal to 2Vs, and Vc(AY) is equal to Vs. Responding to the transition from the state [3'] to the state [4], display discharge is generated again in which the first display electrode is an anode. After that, the transition from the state [4] to the state [1] is performed, and the above-mentioned state transition is repeated.

As explained above, the conventional driving method in which a sustain pulse having a simple rectangular waveform is applied includes the relationship between the cell voltage at the XY-interelectrode and the cell voltage at the AY-interelectrode at the instant when display discharge is generated like the state [2] and the state [4], i.e., Vc(XY) is equal to 2×Vc(AY). This relationship holds fixedly whichever value the pulse amplitude (Vs) is set to within a tolerance for optimizing the drive condition. Namely, in a cell voltage plane, the state [2] and the state [4] are always positioned on the line that passes through the origin (i.e., the intersection of two axes) and has the gradient ½. Such dependency of luminance and light emission efficiency on the drive voltage in the conventional driving method is shown in FIG. 15. The drive voltage is the sustain voltage (Vs) that is applied at the XY-interelectrode for display discharge, and the light emission efficiency is the light emission quantity [1 m] per unit consumption electric power [W]. As shown in FIG. 15, the conventional method has a problem that the light emission efficiency is reduced when trying to increase the luminance. Concerning solution for this problem, Japanese unexamined patent publication No. 10-333635 discloses a drive waveform for applying a voltage temporarily higher than a normal voltage at start of the display discharge to the display electrode pair and then applying the normal voltage. However, it is found that this waveform cannot improve the display operation characteristics remarkably.

SUMMARY OF THE INVENTION

An object of the present invention is to improve luminance and light emission efficiency in display discharge.

According to the one aspect of the present invention, after the addressing for producing wall charge in cells to be lighted, potential of at least one display electrode is altered so as to differ between start time point and end time point of display discharge for generating display discharge and following reproduction of the wall charge in the cell, and potential of at least one electrode except the display electrode is altered so as to differ between the start time point and the end time point of the display discharge. To alter the potential of the display electrode means to apply a voltage signal having a waveform that is not a simple rectangular wave between the display electrodes. By altering drive voltage that is applied between the display electrodes and the potential difference between the display electrode and the other electrode, choices for setting cell state concerning the display discharge are diversified, and display characteristics can be improved sufficiently.

In a PDP having a structure in which electrodes are covered with a dielectric layer, the cell voltage is the sum of the drive voltage and the wall voltage. Furthermore, the display discharge is not determined only by an absolute potential of the display electrode but depends on the potential difference between the display electrode and the other electrode as well as the variation thereof. If the number of electrodes relevant to one cell is N, relationship among N electrodes are derived from analysis of voltage at N−1 interelectrodes. Namely, cell voltage and display discharge are expressed by N−1 dimensional space. In the N−1 dimensional space, the variation of the cell voltage along with transition of drive voltage between electrodes is N−1 dimensional vector. In order to improve luminance and light emission efficiency, voltage of at least N−1 interelectrodes must be different between the start time point and the need time point of display discharge. Especially, in a three-electrode structure PDP, potential of either first or second display electrode and potential of the address electrode must be different between the start time point and the end time point of the display discharge.

In driving a three-electrode structure PDP, there are five kinds of pulses for making an electrode potential offset between the start time point and the end time point of the display discharge (referred to as a "offset pulse") as shown in FIG. 1, i.e., Pos(Xp), Pos(Yn), Pos(Xn), Pos(Yp) and Pos(A). Pos(Xp) is applied to the first display electrode (X) in the display discharge in which the first display electrode (X) works as an anode. Pos(Yn) is applied to the second display electrode (Y) in the display discharge in which the first display electrode (X) works as an anode (i.e., the display discharge in which the second display electrode (Y) works as a cathode). Pos(Xn) is applied to the first display electrode (X) in the display discharge in which the first display electrode (X) works as a cathode. Pos(Yp) is applied to the second display electrode (Y) in the display discharge in which the first display electrode (X) works as a cathode (i.e., the display discharge in which the second display electrode (Y) works as an anode). Then, Pos(A) is applied to the address electrode (A) for every display discharge. The offset vector of the display discharge in which the first display electrode (X) works as an anode is determined by a combination of Pos(Xp), Pos(Yn) and Pos(A). The offset vector of the display discharge in which the first display electrode (X) works as a cathode is determined by a combination of Pos(Xn), Pos(Yp) and Pos(A).

Here, the combination of Pos(Xp), Pos(Yn) and Pos(A) will be explained as a type. The amplitude values of Pos (Xp), Pos(Yn) and Pos(A) are denoted by Vos(X), Vos(Y) and Vos(A), respectively. A polarity of them is positive when the drive voltage is raised by the pulse application, while it is negative when the drive voltage decreases. The offset voltage Vos(XY) between the display electrodes (at the XY-interelectrode) and the offset voltage Vos(AY) between the address electrode and the second display electrode (at the AY-interelectrode) are expressed by the following equations.

$$Vos(XY)=Vos(X)-Vos(Y)$$

$$Vos(AY)=Vos(A)-Vos(Y)$$

[1] Offset in which the address electrode (A) works as an anode

If the address electrode (A) is an anode, a force is generated that moves ions generated by the discharge away from the address electrode (A). As a result, an ion impact toward a fluorescent material that is located at the vicinity of the address electrode (A) is relieved.

[1-1] Negative pulses having the same amplitude are added to the first display electrode (X) and the second display electrode (Y). This is equivalent to that the offset pulse is applied only to the address electrode (A). However, a withstand voltage of a driver for the address electrode (A) is generally lower than that of a driver for the display electrode. Therefore, when applying an offset pulse only to the address electrode (A), an offset pulse having large amplitude cannot be applied. By applying a negative pulse to the first display electrode (X) and the second display electrode (Y), the offset vector can be enlarged.

[1-2] Negative pulses having different amplitude values are added to the first display electrode (X) and the second display electrode (Y), so as to give the offset voltage also between the display electrodes. This is especially effective to improvement of luminance and light emission efficiency. Furthermore, by adding the offset voltage, the intensity of the display discharge is decreased, and the life of a protection film that covers the dielectric layer can be extended.

[1-3] A negative pulse is added to the first display electrode (X) and the second display electrode (Y), and a positive pulse is applied to the address electrode (A). By applying the offset pulse to all the electrodes, a withstand voltage of a driver for each electrode can be lowered.

[2] Offset in which the address electrode (A) works as a cathode

In general, the address electrode (A) is covered with a fluorescent material. In this structure, comparing the fluorescent material with a protection film that covers the dielectric layer on the display electrodes (X,Y), a secondary electron emission coefficient of the fluorescent material is small. Therefore, the discharge start voltage in the case where the address electrode (A) is a cathode is high. This means that undesired opposed discharge is hardly generated even if an offset is provided and that it contributes both to reduction of power consumption and elongation of life of the fluorescent material.

[2-1] Positive pulses having the same amplitude are applied to the first display electrode (X) and the second display electrode (Y).

[2-2] Positive pulses having different amplitude values are applied to the first display electrode (X) and the second display electrode (Y).

[2-3] A negative pulses is applied to the first display electrode (X) and the second display electrode (Y), and a positive pulse is applied to the address electrode (A).

[2-1], [2-2] and [2-3] have an advantage similar to [1-1], [1-2] and [1-3]. Furthermore, though the waveform of the sustain pulse that is applied to the first display electrode (X) and the second display electrode (Y) is a sharp-edged simple rectangular shape in FIG. 1, this is a simplified expression. Actually, since a cell has capacitance, it becomes a blunt-edged waveform. In addition, if the known power recycling control is performed, potential of the display electrode increases or decreases step by step from a microscopic view. Pos(Xp), Pos(Yn), Pos(Xn) and Pos(Yp) are added to the sustain pulse having the above-mentioned waveform, so that the effect of the present invention is created.

DESCRIPTION OF THE PREFERRED EMBODIMENTS

Hereinafter, the present invention will be explained more in detail with reference to embodiments and drawings.

Figure 1:
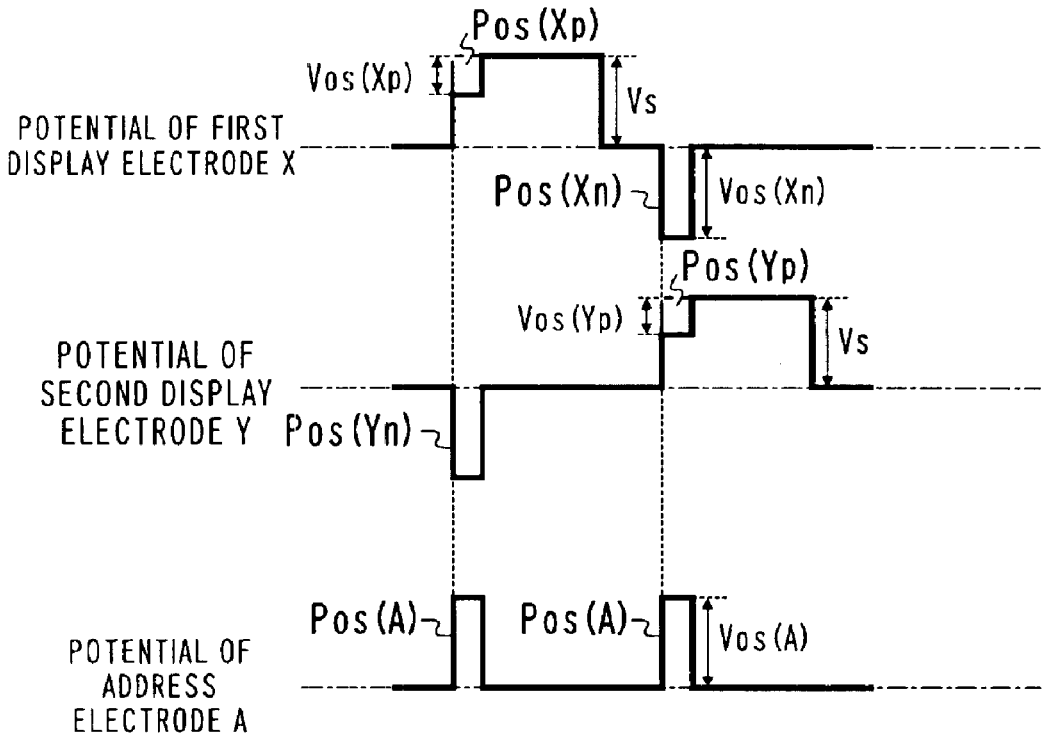
FIG. 1 is an explanatory diagram of an offset pulse.
Figure 2:
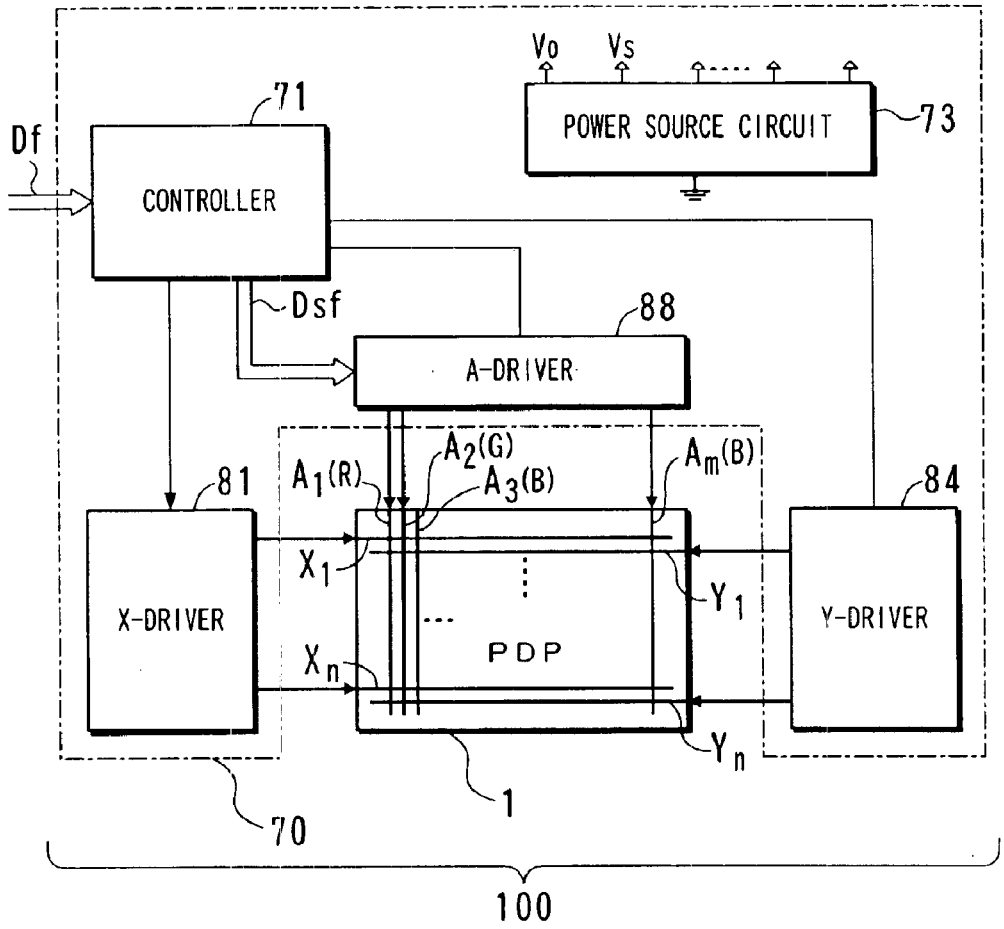
FIG. 2 is a block diagram of a display device according to the present invention.

FIG. 2 is a block diagram of a display device according to the present invention. The display device 100 comprises a three-electrode structure PDP 1 having a 32-inch color display screen and a drive unit 70 that controls light emission of cells. The display device 100 is used as a wall-hung television set, a monitor of a computer system or others.

The PDP 1 comprises a pair of substrate structural bodies 10 and 20. The substrate structural body means a structural body that has a glass substrate on which electrodes and other elements are disposed. In the PDP 1, display electrodes X and Y constituting an electrode pair for generating display discharge are arranged in the same direction, and address electrodes A are arranged so as to cross the display electrodes X and Y. The display electrodes X and Y extend in the row direction (the horizontal direction) of the screen and are covered with a dielectric layer and a protection film. The display electrode Y is used as a scan electrode. The address electrodes A extend in the column direction (the vertical direction), and the address electrode A is used as a data electrode. In FIG. 2, the suffix (1 and n) of the reference letter of the display electrodes X and Y indicates an arrangement order of the corresponding "row", and the suffix (1-m) of the reference letter of the address electrode A indicates an arrangement order of the corresponding "column". The row is a set of m cells corresponding to the number of columns having the same arrangement order in the column direction, while the column is a set of n cells corresponding to the number of rows having the same arrangement order in the row direction. The alphabet letters R, G and B in parentheses indicate light emission color of a cell corresponding to the element that is attached to the letter.

The drive unit 70 includes a controller 71, a power source circuit 73, an X-driver 81, a Y-driver 84 and an A-driver 88. The drive unit 70 is supplied with frame data Df that indicate luminance levels of red, green and blue colors and various synchronizing signals from an external device such as a TV tuner or a computer. The frame data Df are temporarily stored in a frame memory of the controller 71. The controller 71 converts the frame data Df into subframe data Dsf for gradation display and sends them to the A-driver 88. The subframe data Dsf is a set of display data including a bit per cell, and the value of each bit indicates whether the corresponding cell of one subframe is to be lighted or not, more specifically whether address discharge is necessary or not. In the case of an interlace display, each of plural fields that constitute a frame is made of plural subfields, and light emission control is performed for each subfield. However, the process of the light emission control is the same as the progressive display.

Each of the X-driver 81, the Y-driver 84 and the A-driver 88 includes a switching device for applying a pulse to an electrode and opens or closes a conductive path between the electrode and the bias power source line corresponding to the pulse amplitude in accordance with an instruction from the controller 71.

Figure 3:
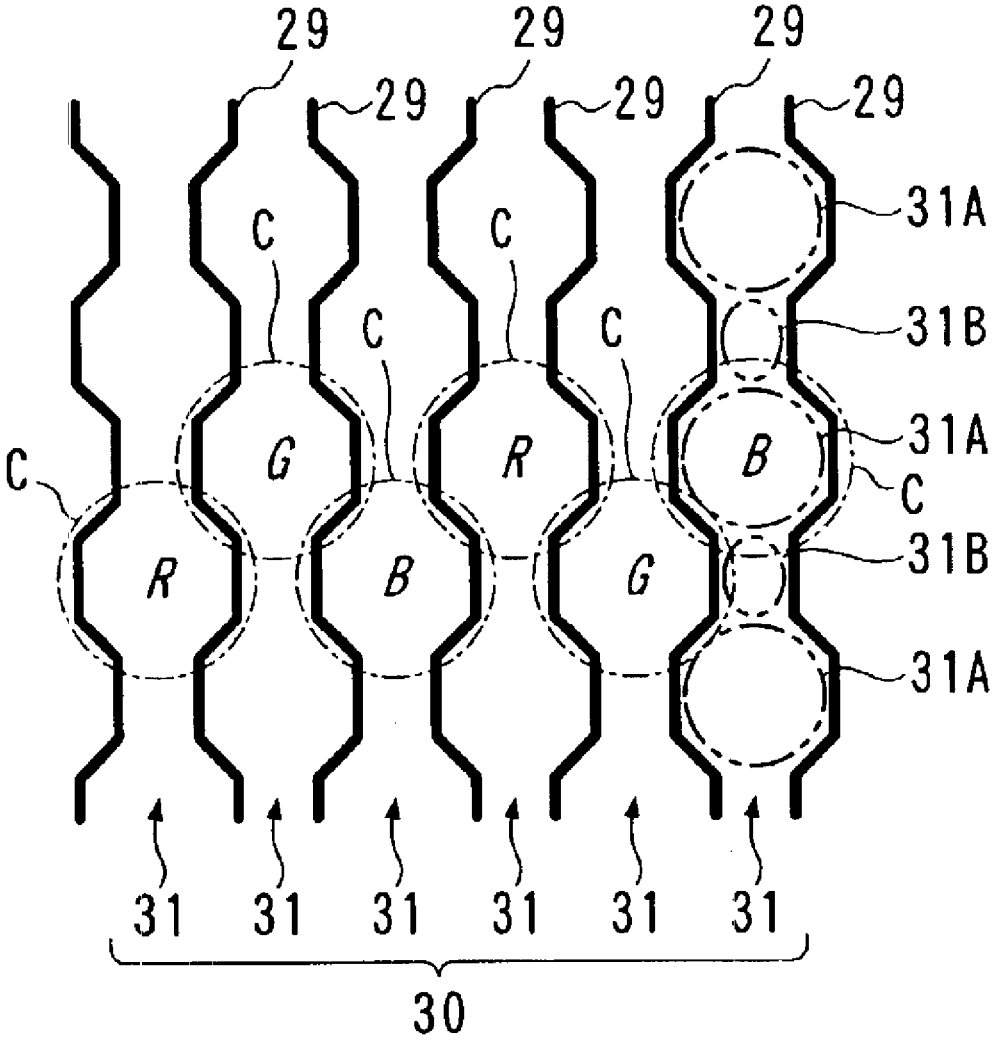
FIG. 3 is a plan view showing a cell arrangement of a display screen.

FIG. 3 is a plan view showing a cell arrangement of a display screen.

In a display screen, a discharge space 30 is divided into columns by regularly meandering partitions 29, so that column spaces 31 are formed, which has wide portions (portions with large width in the row direction) 31A and narrow portions (portions with small width) 31B arranged alternately. Namely, each partition 29 is waving at a constant pitch and width in a plan view, and the distance between neighboring partitions 29 becomes smaller than a predetermined value at a constant pitch in the column direction. The predetermined value is a size that can suppress discharge and depends on discharge conditions such as gas pressure. The structure in which the column space 31 between the neighboring partitions continues over all rows has advantages in easy drive due to priming by column unit, a uniform film thickness of the fluorescent material layer and easy exhaustion process in manufacturing. Since surface discharge is hard to be generated at the narrow portion 31B, the wide portion 31A substantially contributes to light emission. Namely, each cell C is a structural body within the area of one wide portion 31A in the display screen. In each row, a cell is located in every other column. Noting neighboring two rows, the column in which a cell is located is changed in every column. Namely, cells are located in a zigzag manner both in the row direction and in the column direction. In FIG. 3, five cells C are shown by dot-dashed circles (a little larger area than real is enclosed for ready viewing in FIG. 3). In PDP 1, three cells of red, green and blue constitute one pixel, and the three color cells are arranged in triangle (delta) form. The triangle arrangement has an advantage for high definition compared with an inline arrangement since the width of the cell is larger than one third of the pixel pitch in the row direction. In addition, since the ratio of non-lighted area to the screen is small, high luminance display can be performed. Furthermore, the horizontal direction is not necessarily the row direction, but the vertical direction can be the row direction while the horizontal direction is the column direction.

Figure 4:
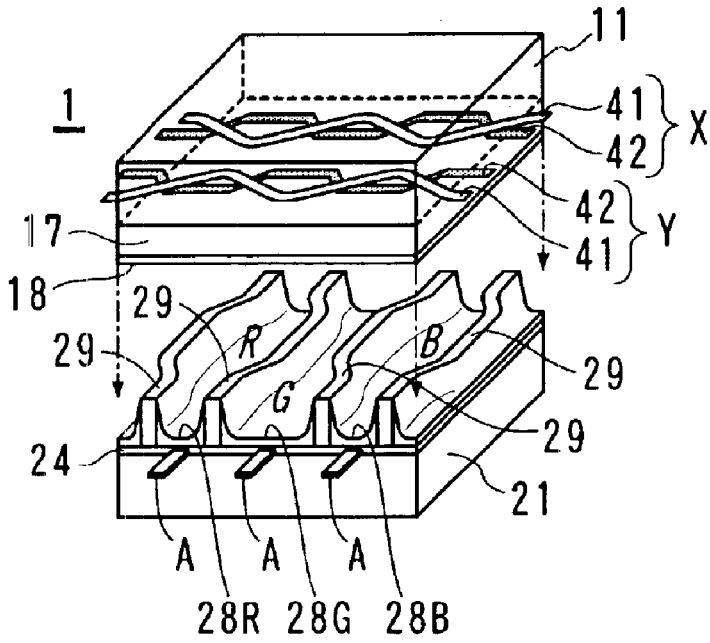
FIG. 4 is a perspective view showing a cell structure of a PDP.

FIG. 4 is a perspective view showing a cell structure of a PDP.

In the PDP 1, the display electrodes X and Y, the dielectric layer 17 and the protection film 18 are disposed on the inner surface of the front glass substrate 11, and the address electrodes A, an insulator layer 24, the partition 29 and fluorescent material layers 28R, 28G and 28B are disposed on the inner surface of the back glass substrate 21. Each of the display electrodes X and Y includes a transparent conductive film 41 that forms a surface discharge gap and a metal film 42 as a bus conductor. The display electrodes X and the display electrodes Y are arranged alternately at a constant pitch (a surface discharge gap) in the column direction. The gap direction of the surface discharge gap, i.e., the opposing direction of the display electrodes X and Y is the column direction.

Figure 5:
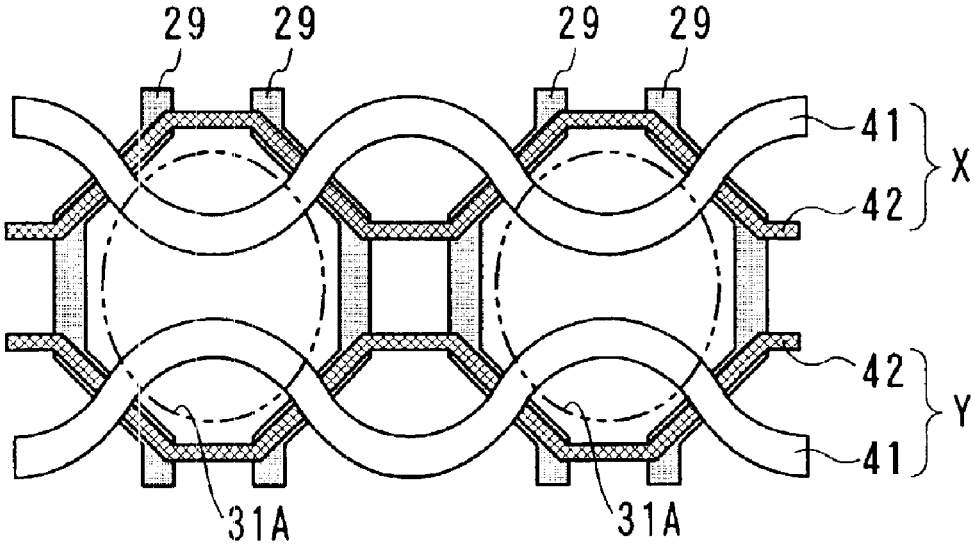
FIG. 5 is a plan view showing a shape of the display electrode.

FIG. 5 is a plan view showing a shape of the display electrode.

Each of the display electrodes X and Y includes the transparent conductive film 41 extending in the row direction meandering in the column direction and the band-like metal film 42 extending in the row direction meandering along the partition 29 so as to avoid the wide portion 31A. The transparent conductive film 41 has a band-like shape curving like a wave and has a arc gap forming portion protruding from the metal film 42 to the wide portion 31A in each column. In each wide portion 31A, the gap forming portion of the display electrode X and the gap forming portion of the display electrode Y are opposed to each other so as to form a drum-shaped surface discharge gap. In the opposed gap forming portions, the opposed sides are not parallel. Furthermore, the width of the band-like transparent conductive film 41 can be varied regularly. According to this electrode shape, compared with a linear band-like shape, capacitance of the interelectrode distance can be reduced without increasing the surface discharge gap length (i.e., the shortest distance between electrodes). In addition, since the distance between the transparent conductive film 41 and the metal film 42 in the middle of the wide portion 31A in the row direction is large, intensity of electric field generated in the gap between the transparent conductive film 41 and the metal film 42 is small. This contributes to prevention of discharge interference between rows. In addition, as an indirect effect, light shield effect of the metal film 42 is relieved, so that the light emission efficiency is increased.

Figure 6:
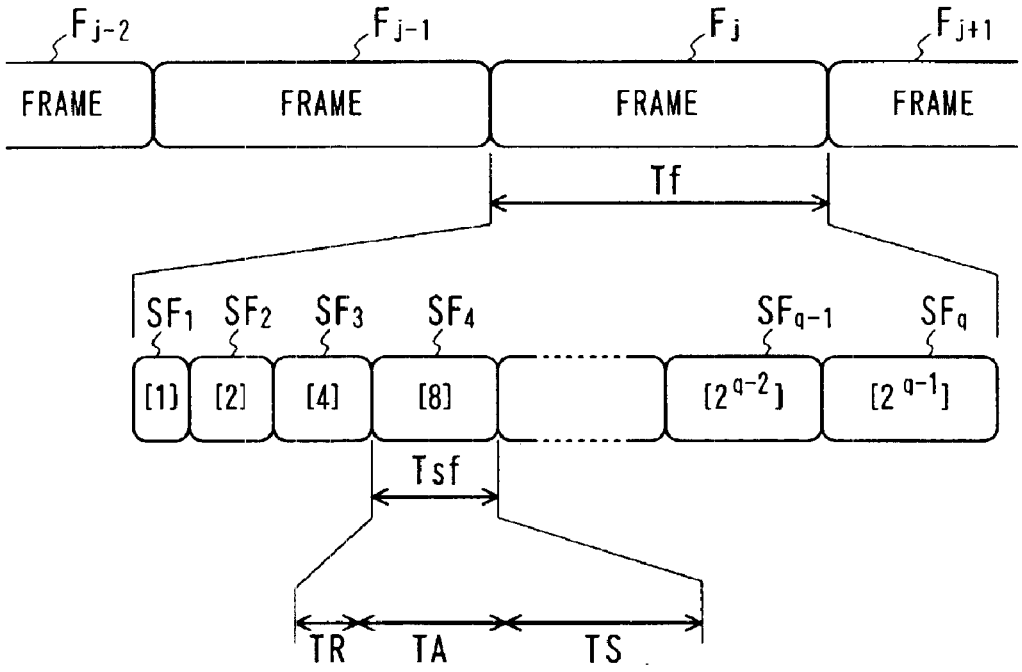
FIG. 6 shows a concept of frame division.

FIG. 6 shows a concept of frame division. In a display using the PDP 1, in order to perform color reproduction by binary lighting control, each of the sequential frames F that is an input image is divided into a predetermined number q of subframes SF. Namely, each frame F is replaced with a set of q subframes SF. To these subframes SF, weights such as $2^0, 2^1, 2^2, \ldots 2^{q-1}$ are assigned sequentially so as to set the number of times of display discharge in each subframe SF. In FIG. 6, the subframe arrangement is in the order of weights, but it can be other orders. Redundant weighting can be adopted for reducing false contours. In accordance with this frame structure, the frame period Tf that is a frame transmission period is divided into q subframe periods Tsf, and one subframe period Tsf is assigned to each subframe SF. In addition, the subframe period Tsf is divided into a reset period TR for initialization, an address period TA for addressing and a display period TS for sustaining. The reset period TR and the address period TA have a constant length regardless of the weight, while the display period TS has a variable length that is longer as the weight is larger. Therefore, the length of the subframe period Tsf is also longer as the weight of the corresponding subframe SF is larger. The driving sequence is repeated for each subframe, and the order of the reset period TR, the address period TA and the display period TS is the same in q subframes SF. Hereinafter, a drive waveform in the display period TS that is relevant to the feature of the present invention will be explained.

Figure 7:
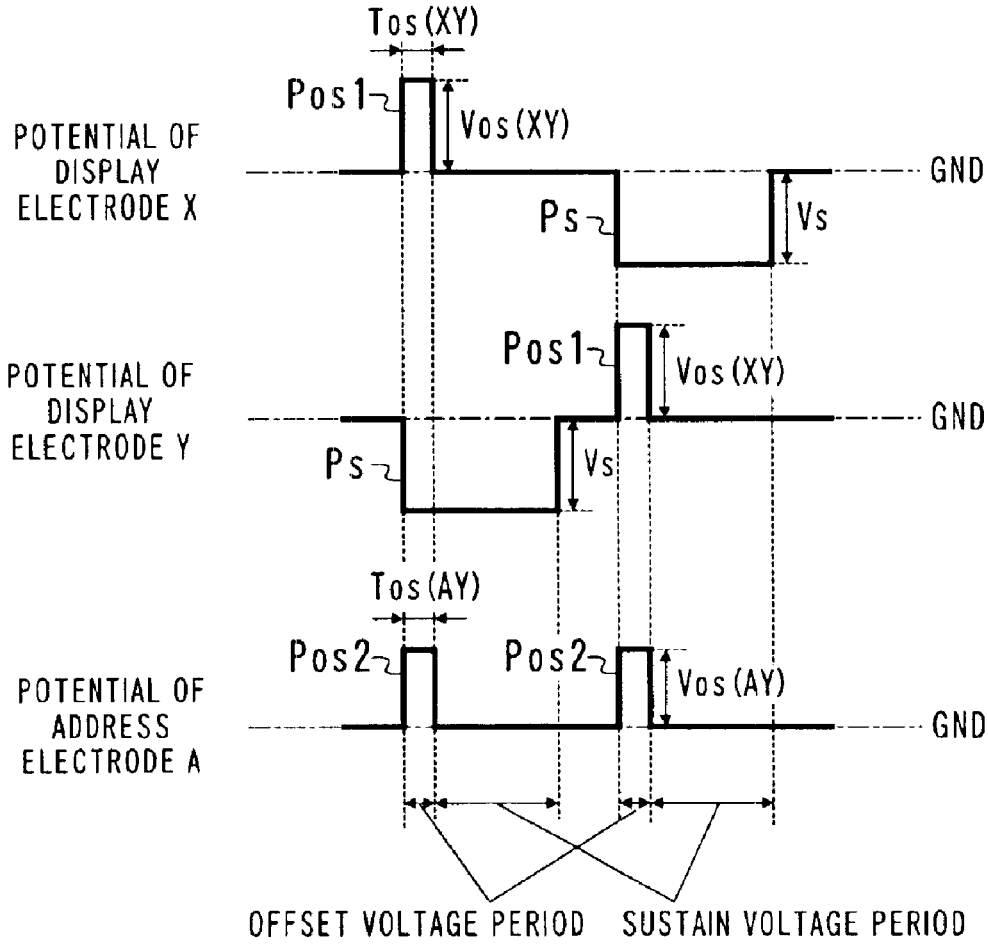
FIG. 7 is a waveform diagram of the drive voltage signal in the display period.
Figure 8:
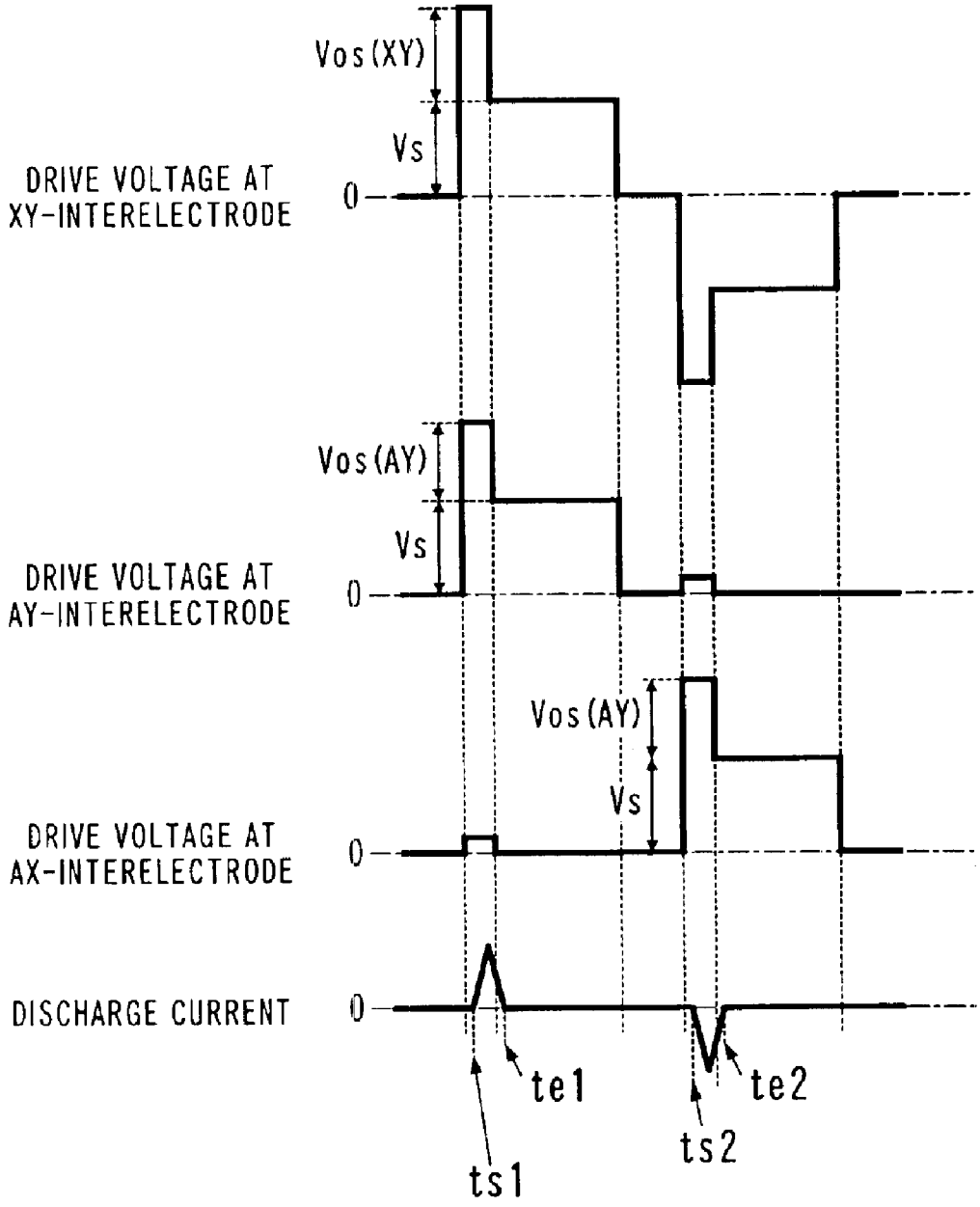
FIG. 8 shows the relationship between the drive voltage variation and discharge.

FIG. 7 is a waveform diagram of the drive voltage signal in the display period. FIG. 8 shows the relationship between the drive voltage variation and discharge. In FIGS. 7 and 8, drive voltage signals concerning two times of display discharge are shown. In a subframe generating three or more display discharge, the illustrated drive voltage signals are applied to each electrode repeatedly. Furthermore, the drive voltage signal that is applied between electrodes is a combined signal of the drive voltage signals corresponding to the electrodes.

As shown in FIG. 7, a drive voltage signal including a sustain pulse Ps and an offset pulse Pos1 is applied to the display electrode X and the display electrode Y, while a drive voltage signal including an offset pulse Pos2 is applied to the address electrode A. The sustain pulse Ps is applied to the display electrode X and the display electrode Y alternately, and display discharge is generated in every application. This is because that the amplitude Vs of the sustain pulse Ps is set so that the cell voltage exceeds the discharge start voltage at the XY-interelectrode by applying the sustain pulse Ps even if the amplitude Vos(XY) of the offset pulse Pos1 is zero. When the sustain pulse Ps is applied to one of the display electrodes X and Y, the offset pulse Pos1 is applied to the other display electrode simultaneously. The pulse width Tos(XY) of the offset pulse Pos1 is set to a value substantially smaller than the pulse width of the sustain pulse Ps (approximately a few micro seconds) so that the drive voltages of the XY-interelectrode are different between the start time point ts1 or ts2 and the end time point te1 or te2 of the display discharge as shown in FIG. 8, in other words, so that the application of the offset pulse Pos1 is finished and the drive voltage changes from Vs+Vos(XY) to Vs during the display discharge. More specifically, the pulse width Tos(XY) is a value within the range of 100–200 ns. The offset pulse Pos2 is applied to the address electrode A simultaneously when the sustain pulse Ps is applied to the display electrode X and the display electrode Y. When the application of the offset pulse Pos2 is finished, the drive voltage at the AY-interelectrode or at the AX-interelectrode (between the address electrode A and the display electrode X) is altered from Vs+Vos(AY) to Vs during display discharge. The pulse width Tos(AY) of the offset pulse Pos2 is also substantially shorter than the pulse width of the sustain pulse Ps (The specific value is the same as the offset pulse Pos1).

Figure 9:
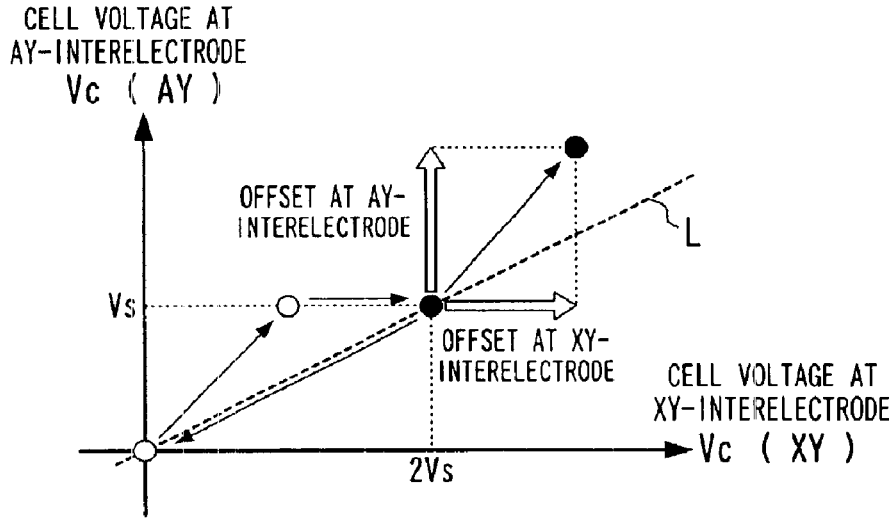
FIG. 9 is a cell voltage plan view showing a display process according to the present invention.

FIG. 9 is a cell voltage plan view showing a display process according to the present invention. The explanation here will be performed about the display discharge as a type in which the display electrode X works as an anode and the display electrode Y works as a cathode since the display electrodes X and Y are arranged symmetrically in a cell and the functions of the display electrodes X and Y are the same in the display discharge.

When the offset pulse Pos1 is added to the sustain pulse Ps, the cell voltage at the discharge start time point moves along the horizontal axis as shown in FIG. 9. In addition, when the offset pulse Pos2 is added to the sustain pulse Ps, the cell voltage at the discharge start time point moves along the vertical axis as shown in FIG. 9. Namely, the application of the offset pulse Pos1 and the offset pulse Pos2 causes two-dimensional movement in the cell voltage plane. This means that the relationship between the cell voltage at the XY-interelectrode and the cell voltage at the AY-interelectrode at the moment of the display discharge generation can be set freely. In the cell voltage plane, the position showing the cell state of the discharge start time point (indicated by a dot in FIG. 9) is not limited to a point on the line L that passes the origin and has the gradient ½. When setting the amplitude Vos(XY) of the offset pulse Pos1 and the amplitude Vos(AY) of the offset pulse Pos2, i.e., the offset voltage appropriately, the luminance and the light emission efficiency are improved.

Figure 10:
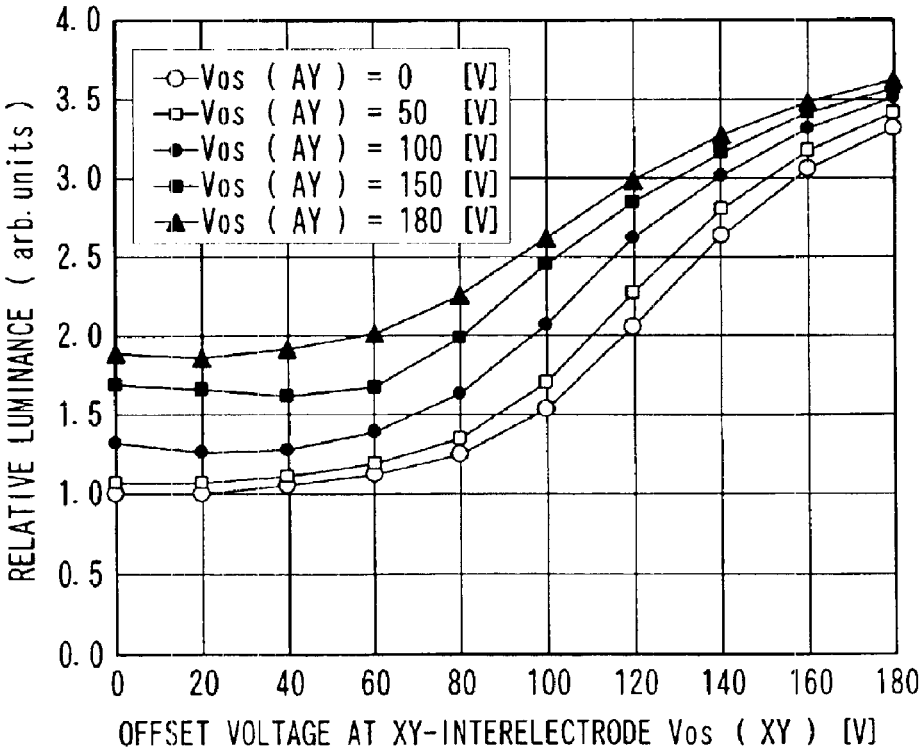
FIG. 10 is a graph showing dependency of the luminance on the offset voltage.
Figure 11:
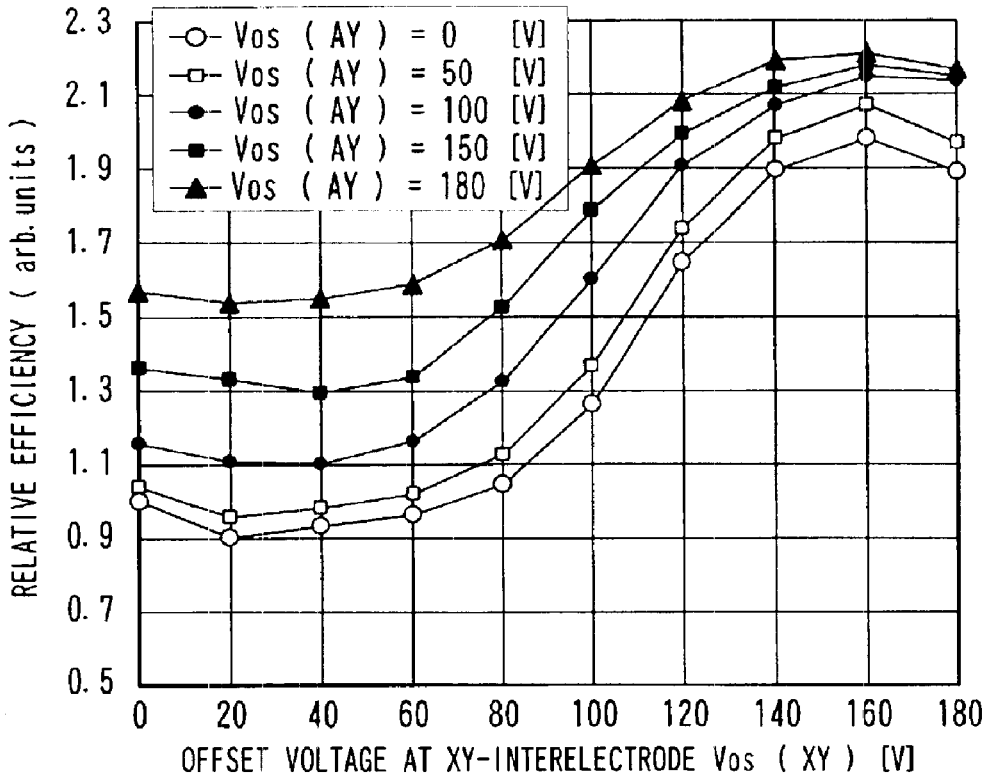
FIG. 11 is a graph showing dependency of the light emission efficiency on the offset voltage.

FIG. 10 is a graph showing dependency of the luminance on the offset voltage. FIG. 11 is a graph showing dependency of the light emission efficiency on the offset voltage. These graphs are results of the experiment in which the PDP 1 is driven under the condition where the amplitude Vs of the sustain pulse Ps is set to 180 volts that is a medium value in the tolerance of the waveform shown in FIG. 7, and using parameters of the offset voltage Vos(XY) and the offset voltage Vos(AY).

The curve indicating Vos(AY)=0 volt shows characteristics in the case where the cell voltage is moved only along the horizontal axis in FIG. 8, i.e., characteristics in the case where the method disclosed in Japanese unexamined patent publication No. 10-333635 is adopted. In contrast, if the cell voltage is moved both along the horizontal axis and along the vertical axis by adding the offset voltage Vos(XY) and the offset voltage Vos(AY), both the luminance and the light emission efficiency are high in any condition of Vos(AY)=50 volts, Vos(AY)=100 volts, Vos(AY)=150 volts and Vos (AY)=180 volts. In addition, the dependency characteristic of the light emission efficiency on Vos(XY) has a sharp peak when Vos(AY)=0 volt, while the dependency characteristic becomes smoother as the offset voltage Vos(AY) is higher. If the characteristic curve is smooth, a margin (the tolerance) for setting the drive voltage is large. Namely, even if the offset voltage Vos(XY) is changed, characteristic changes little. Therefore, it is easy to secure the display quality above a predetermined standard. If the characteristic curve is sharp, the display quality may change substantially only by changing the offset voltage Vos(XY) a little. Therefore, addition of the offset voltage Vos(AY) has an advantage not only in the display characteristics but also in drive control. Furthermore, it is necessary to set the offset voltage Vos(XY) to 160 volts for maximizing the light emission efficiency when Vos(AY)=0 volts, but it is sufficient that Vos(AY)=100 volts and Vos(XY)=130 volts when the offset voltage Vos (AY) is added. The addition of the offset. voltage Vos(AY) also contributes to reduction of the withstand voltage of the driving circuit and reduction of the power source voltage.

Referring the characteristics shown in FIGS. 10 and 11, the luminance and the light emission efficiency can be improved if the offset voltage Vos(AY) has a value within the range of 50–180 volts as explained above. However, a preferable range of the offset voltage Vos(AY) for being remarkably different to the case where the offset voltage Vos(AY) is zero is 100–180 volts. In addition, since the luminance can be improved by 50% or more, a more preferable range of the offset voltage Vos(AY) is 150–180 volts. Concerning the offset voltage Vos(XY) at the XY-interelectrode, a preferable range is 80–180 volts for both the luminance and the light emission efficiency to be improved. For further improvement, a more preferable range of the offset voltage Vos(XY) is 120–180 volts.

Figure 12:
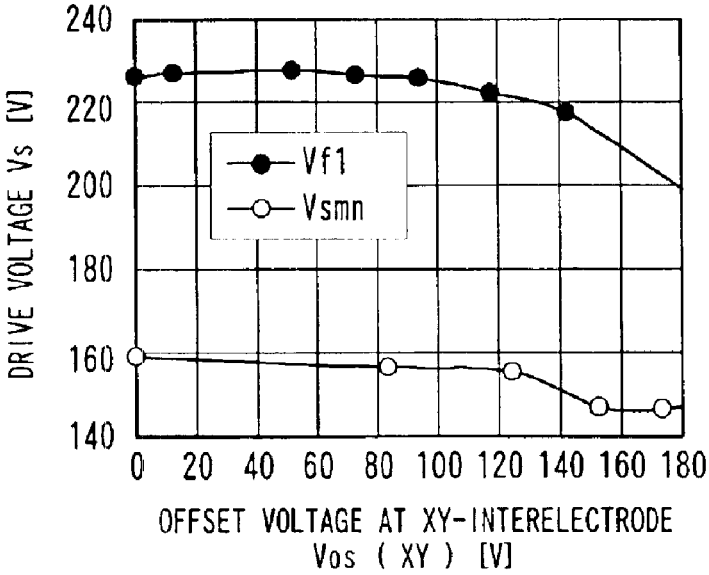
FIG. 12 is a graph showing a drive margin when Vos (AY)=Vos(XY)/2.
Figure 13:
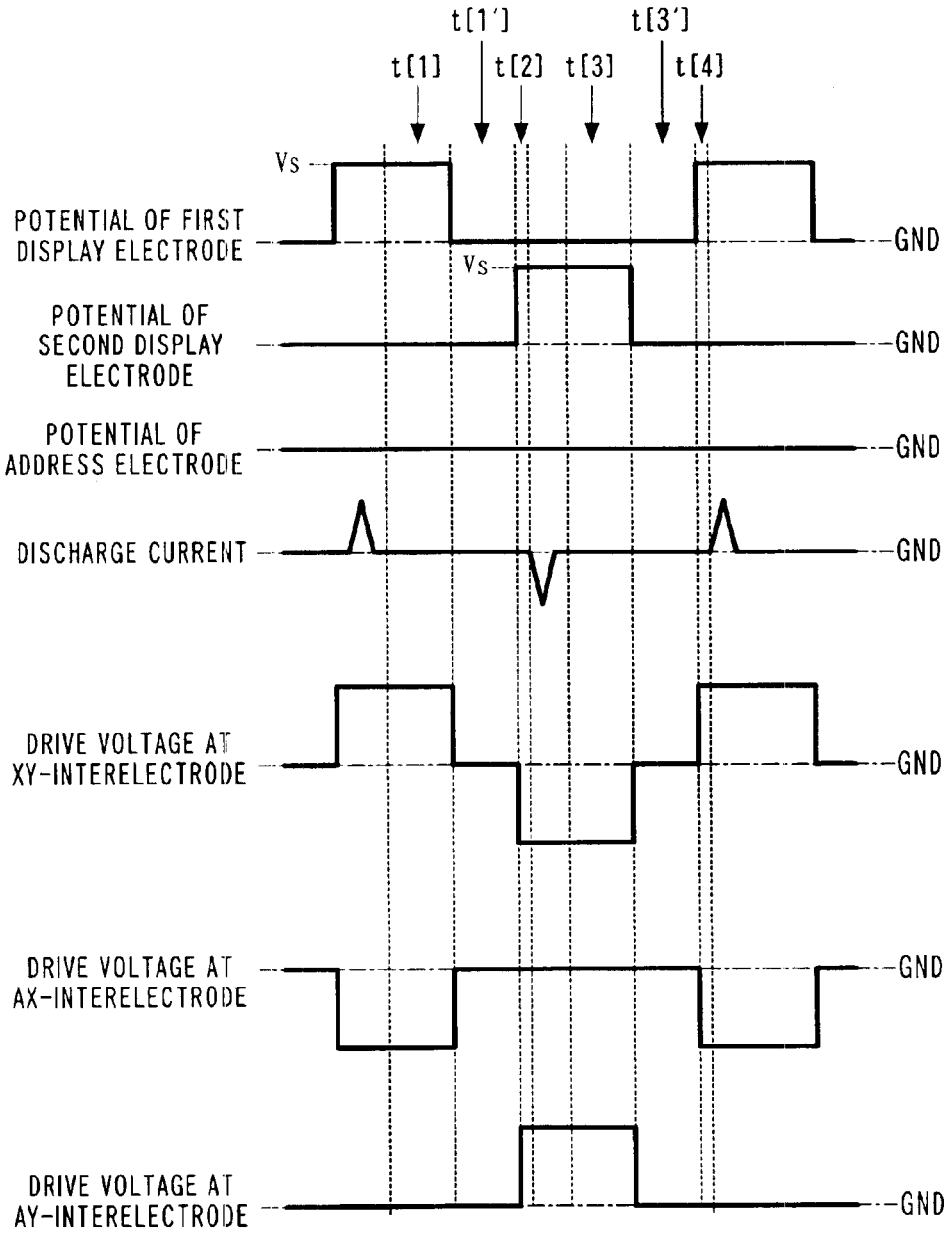
FIG.13 PRIOR ART
FIG. 13 shows a usual drive waveform in the conventional method for display discharge that is applied to the three-electrode structure.
Figure 14:
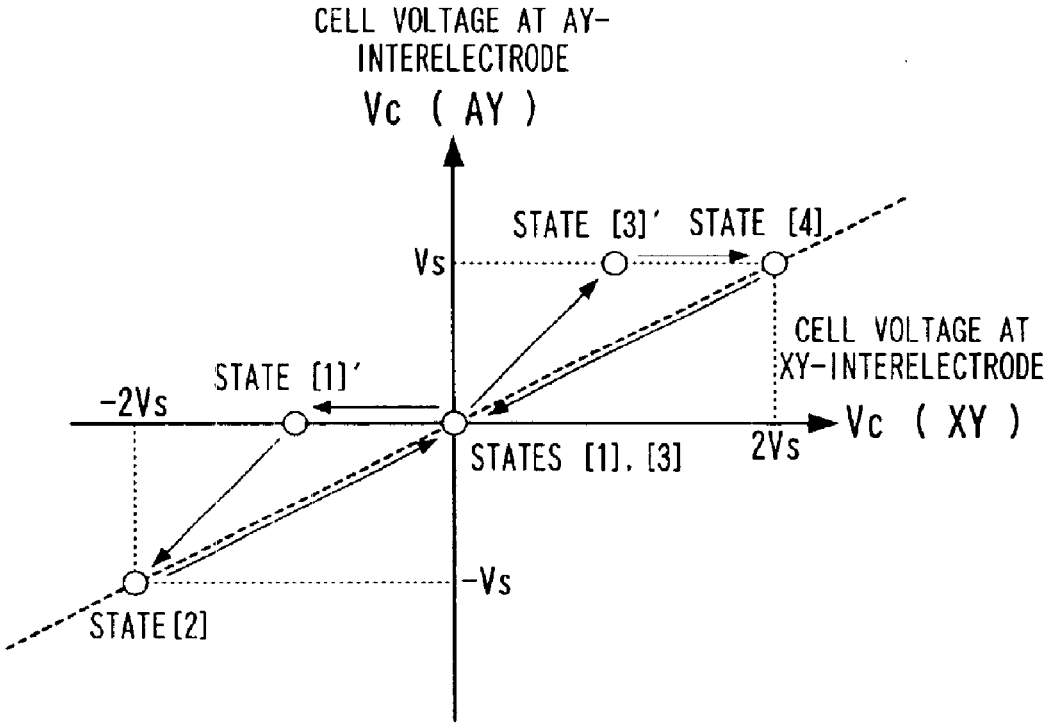
FIG.14 PRIOR ART
FIG. 14 is a cell voltage plan view showing the display process according to the conventional driving method.
Figure 15:
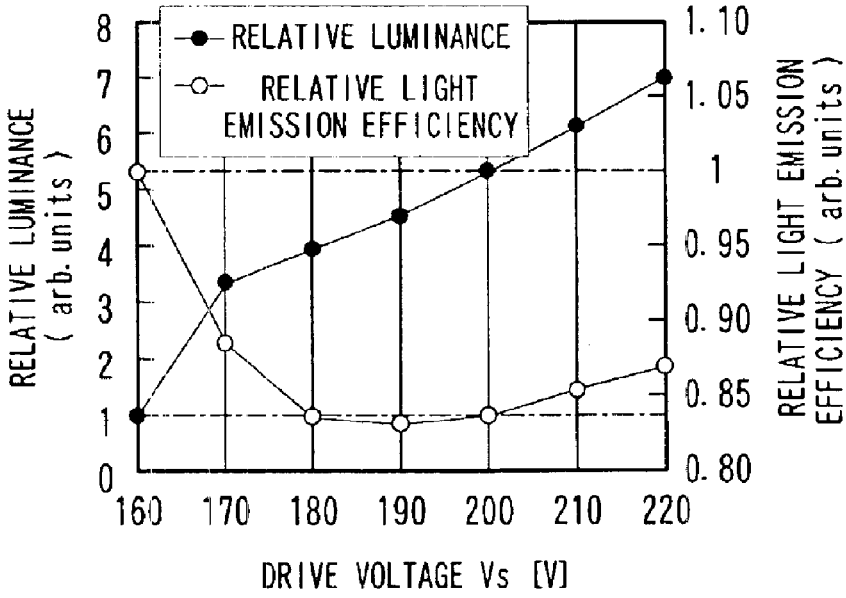
FIG.15 PRIOR ART
FIG. 15 is a graph showing dependency of luminance and light emission efficiency on drive voltage in the conventional driving method.

FIG. 12 is a graph showing a drive margin when Vos (AY)=Vos(XY)/2. The drive margin is a difference between the discharge start voltage Vf1 at the XY-interelectrode and the lowest drive voltage Vsmn necessary for maintaining the lighted state. When the sustain voltage Vs that is amplitude of the sustain pulse Ps is set to a value above Vf1, discharge may be generated also in the cell that was not lighted in addressing. If the sustain voltage Vs is set to a value below Vsmn, the lighting cell may go out. Therefore, the sustain voltage Vs is set to a value between Vf1 and Vsmn. As shown in FIG. 12, if the offset voltage Vos(XY) is raised, Vsmn drops. Namely, the application of the offset voltage Vos(XY) can lower the sustain voltage Vs, thereby the withstand voltage of the driving circuit can be reduced and the power source voltage can be lowered.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method of driving a plasma display panel having cells in each of which are arranged N electrodes, where N=three or more, including a pair of display electrodes covered with a dielectric layer, the method comprising:

performing addressing for producing wall charge in each cell to be lighted;

altering a potential of at least one display electrode in each cell to be lighted, so as to differ between a start time point and an end time point of display discharge, for generating a display discharge and following reproduction of the wall charge in each cell to be lighted; and altering a potential of at least one other electrode, other than the display electrodes, so as to differ between the start time point and the end time point of the display discharge.

2. A method of driving a three-electrode surface discharge AC type plasma display panel having an electrode matrix made of an arrangement of display electrodes and an arrangement of address electrodes, the method comprising:

performing addressing for producing wall charge in cells to be lighted;

altering a potential of at least one display electrode in each of the cells to be lighted, so as to differ between a start time point and an end time point of display discharge, for generating display discharge and following reproduction of the wall charge in each of the cells to be lighted; and altering a potential of the address electrode so as to differ between the start time point and the end time point of the display discharge.

3. The method according to claim 2, wherein a drive voltage signal is applied in a bias period between the display electrodes by a potential control in which one of a pair of display electrodes is temporarily biased and the other display electrode of the pair is biased only in a part of the bias period.

4. The method according to claim 2, wherein a voltage applied between the display electrodes at the start time point of the display discharge is set higher than a voltage applied between the display electrodes at the end time point of the display discharge.

5. The method according to claim 1, wherein a drive voltage signal is applied in a bias period between the pair of display electrodes by a potential control in which one display electrode of the pair is temporarily biased and the other display electrode of the pair is biased only in a part of the bias period.

6. The method according to claim 1, wherein a voltage applied between the display electrodes at the start time point of the display discharge is set higher than a voltage applied between the display electrodes at the end time point of the display discharge.

7. A method of driving a plasma display panel having cells in each of which are arranged N electrodes, in which N=three or more, including a pair of display electrodes covered with a dielectric layer, the method comprising:

performing addressing for producing wall charge in each cell to be lighted; and altering a potential of the respective pair of display electrodes of each cell to be lighted so as to differ, between a start time point and an end time point of display discharge, for generating a display discharge and following reproduction of the wall charge in each of the cells to be lighted, respective directions of the potential alteration being common.

8. The method according to claim 7, wherein a voltage applied between the display electrodes at the start time point of the display discharge is set higher than a voltage applied between the display electrodes at the end time point of the display discharge.

9. A method of driving a plasma display panel having cells in each of which are arranged N electrodes, in which N=three or more, including a pair of display electrodes covered with a dielectric layer, the method comprising:

performing addressing for producing wall charge in cells to be lighted;

altering a potential of the pair of display electrodes so as to differ, between a start time point and an end time point of display discharge, for generating display discharge and following reproduction of the wall charge in each of the cells to be lighted, respective directions of the display electrode potential alteration being common; and altering a potential of at least one other electrode, other than a display electrode, so as to differ between the start time point and the end time point of the display discharge, a direction of the other electrode potential alteration being opposite to a direction of the display electrode potential alteration.

10. The method according to claim 9, wherein a voltage applied between the display electrodes at the start time point of the display discharge is set higher than a voltage applied between the display electrodes at the end time point of the display discharge.

11. A method of driving a three-electrode surface discharge AC type plasma display panel having an electrode matrix comprising an arrangement of display electrodes and an arrangement of address electrodes, the method comprising:

performing addressing for producing wall charge in each cell to be lighted; and altering a potential of a pair of display electrodes so as to differ, between a start time point and an end time point of display discharge for generating a display discharge and following reproduction of the wall charge in each of the cells to be lighted, respective directions of the display electrode potential alteration being common.

12. The method according to claim 11, wherein a voltage applied between the display electrodes at the start time point of the display discharge is set higher than a voltage applied between the display electrodes at the end time point of the display discharge.

13. A method of driving a three-electrode surface discharge AC type plasma display panel having an electrode matrix made of an arrangement of display electrodes and an arrangement of address electrodes, the method comprising:

performing addressing for producing wall charge in cells to be lighted;

altering a potential of a pair of display electrodes so as to differ, between a start time point and en end time point of display discharge, for generating display discharge and following reproduction of the wall charge in each of the cells to be lighted, respective directions of the alteration being common; and altering a potential of the address electrodes so as to differ, between the start time point and the end time point of the display discharge, a direction of the address electrode potential alteration being opposite to the direction of the display electrode potential alteration.

14. The method according claim 13, wherein a voltage applied between the display electrodes at the start time point of the display discharge is set higher than applied voltage between the display electrodes at the end time point of the display discharge.

* * * * *

UNITED STATES PATENT AND TRADEMARK OFFICE

CERTIFICATE OF CORRECTION

PATENT NO. : 6,888,316 B2
APPLICATION NO. : 10/335864
DATED : May 3, 2005
INVENTOR(S) : Yoshiho Seo et al.

It is certified that error appears in the above-identified patent and that said Letters Patent is hereby corrected as shown below:

Column 13, line 8, change “en” to -- an --.

Column 14, line 6, after “according” insert -- to --.

Signed and Sealed this

Eleventh Day of July, 2006

JON W. DUDAS
*Director of the United States Patent and Trademark Office*